United States Patent [19]

Moghe

[11] Patent Number: 4,818,578

[45] Date of Patent: Apr. 4, 1989

[54] COMPOSITE STRUCTURE ATTACHMENT SYSTEM

[75] Inventor: Sharad R. Moghe, Northfield Center, Ohio

[73] Assignee: The B. F. Goodrich Company, Akron, Ohio

[21] Appl. No.: 142,381

[22] Filed: Jan. 11, 1988

[51] Int. Cl.[4] ..... B32B 3/00

[52] U.S. Cl. ..... 428/57; 403/116; 403/400; 411/230; 411/231; 411/234; 411/245; 411/260; 428/58; 428/61; 428/81; 428/99; 428/157; 428/192; 428/193; 428/223; 428/251; 428/268; 428/417

[58] Field of Search ..... 428/57, 58, 61, 81, 428/99, 157, 192, 193, 223, 251, 268, 417; 403/400, 116; 411/260, 245, 231, 230, 234

[56] References Cited

U.S. PATENT DOCUMENTS

| | | | |
|---|---|---|---|
| 167,118 | 8/1875 | Pritchett | 403/260 |
| 256,560 | 4/1882 | Forg | 411/400 |
| 470,995 | 3/1892 | Duchemin | 403/231 |
| 736,586 | 8/1903 | Dougherty . | |
| 922,222 | 5/1909 | Weatherly | 411/400 |
| 924,084 | 6/1909 | Maddox | 411/400 |
| 1,083,865 | 1/1914 | Sloss | 403/231 |
| 1,776,769 | 9/1930 | Baxter | 411/116 |
| 1,939,034 | 12/1933 | Bennett | 411/400 |
| 1,955,353 | 4/1934 | Wiley | 411/400 |
| 2,040,374 | 5/1936 | Grimes | 403/260 |
| 3,075,622 | 1/1963 | Attwood | 403/245 |
| 3,463,525 | 8/1969 | Stewart | 411/400 |
| 3,603,546 | 9/1971 | Ruffert | 403/230 |
| 4,358,214 | 11/1982 | Shull | 403/234 |

OTHER PUBLICATIONS

The Woodworkers' Store Catalog Sampler, 1987, p. 32.

*Primary Examiner*—Marion E. McCamish
*Attorney, Agent, or Firm*—J. R. Lindsay; D. M. Ronyak; F. K. Lacher

[57] ABSTRACT

A load-bearing member is positioned in a slot extending through a composite structure of laminated reinforced plastic having overlapping layers of fabric plies embedded in a thermoplastic material. A connecting means such as a shank of a bolt connects the load-bearing member with a second structure. The load-bearing member has a flat surface engageable with a flat surface of the slot which is generally parallel with the edge surface of the composite structure in abutting relationship with a surface of the second structure. The slot extends through the overlapping layers of fabric plies in such a manner that the load is distributed by the load-bearing member to avoid the concentration of forces which cause shear failure and delamination.

10 Claims, 3 Drawing Sheets

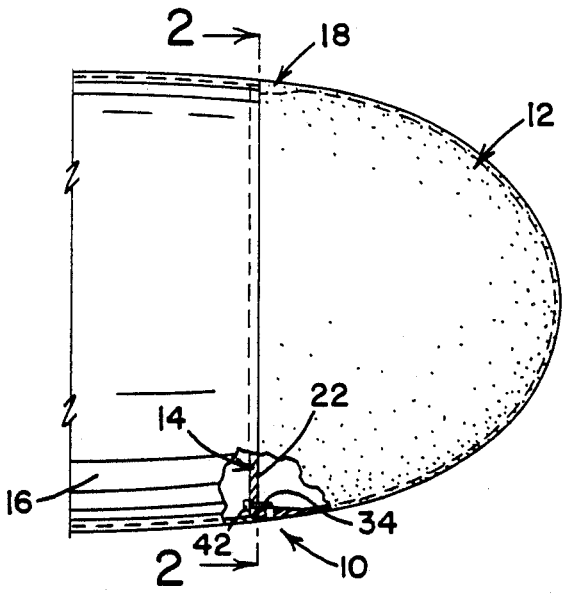
FIG. 1
FIG. 3
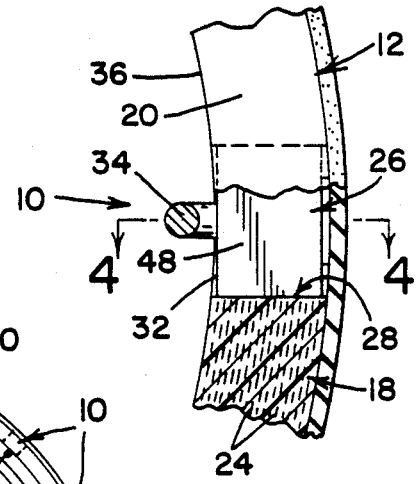
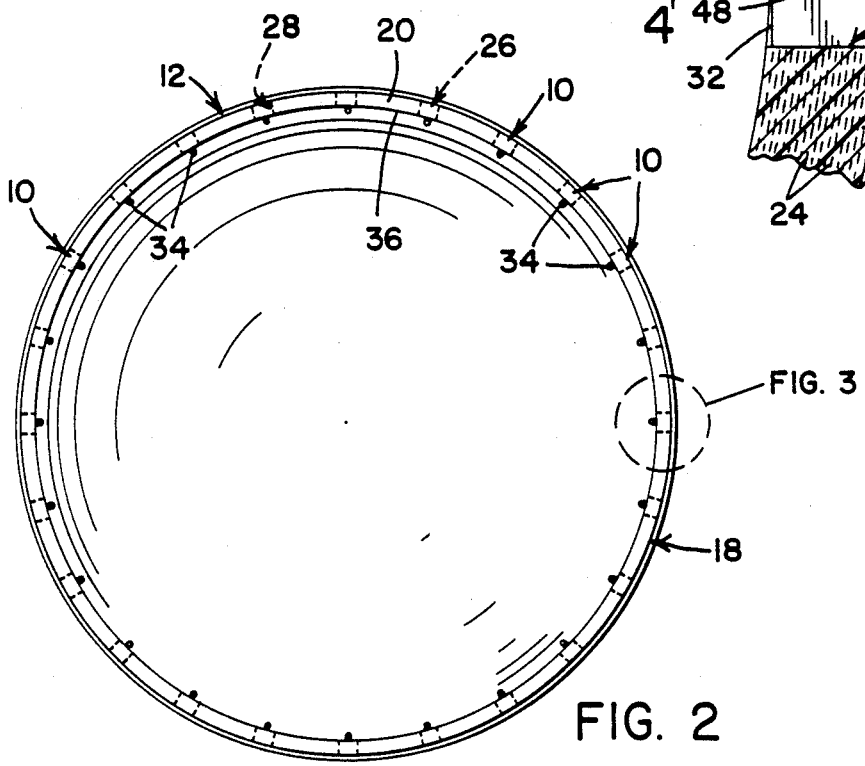
FIG. 2

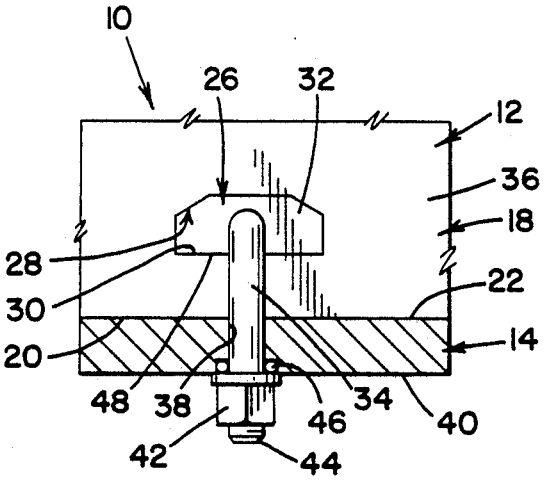
FIG. 5
FIG. 4
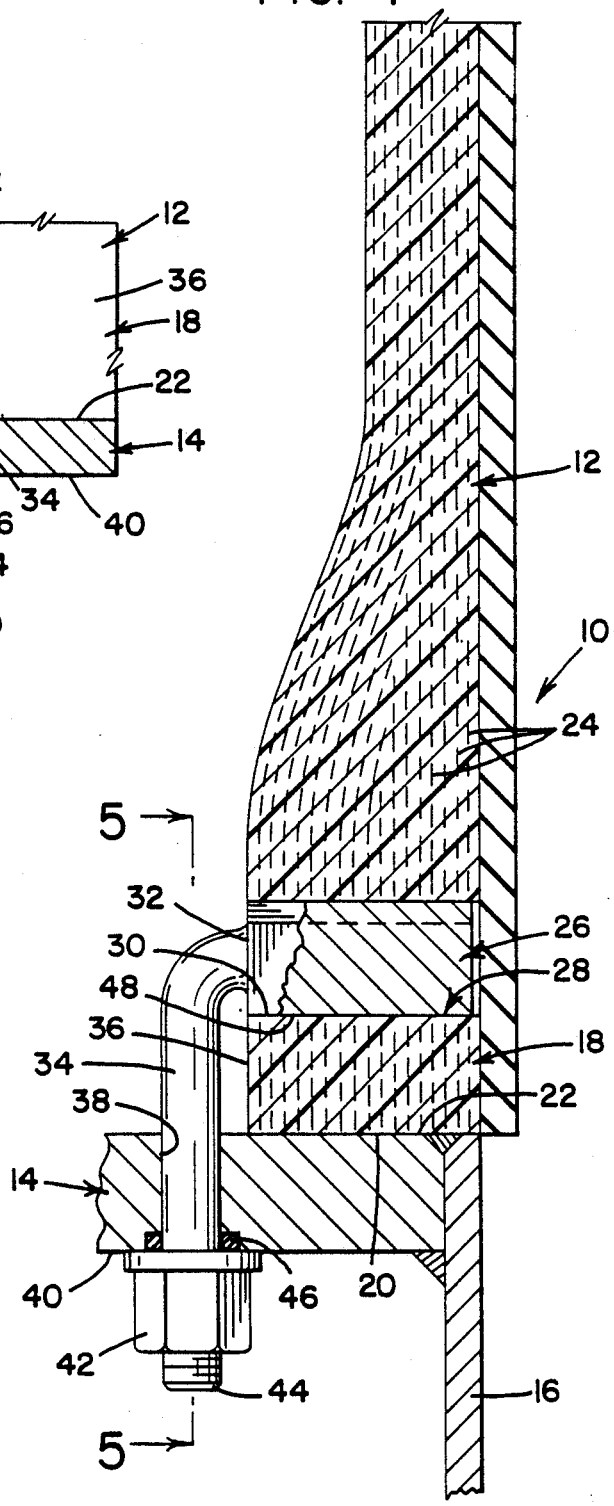

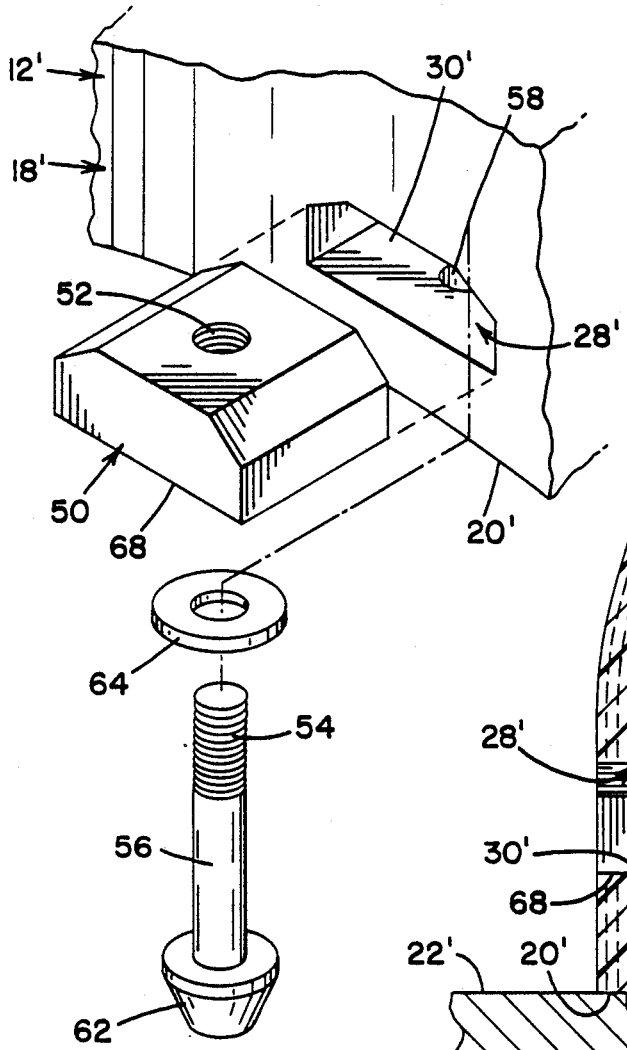
FIG. 7
FIG. 6
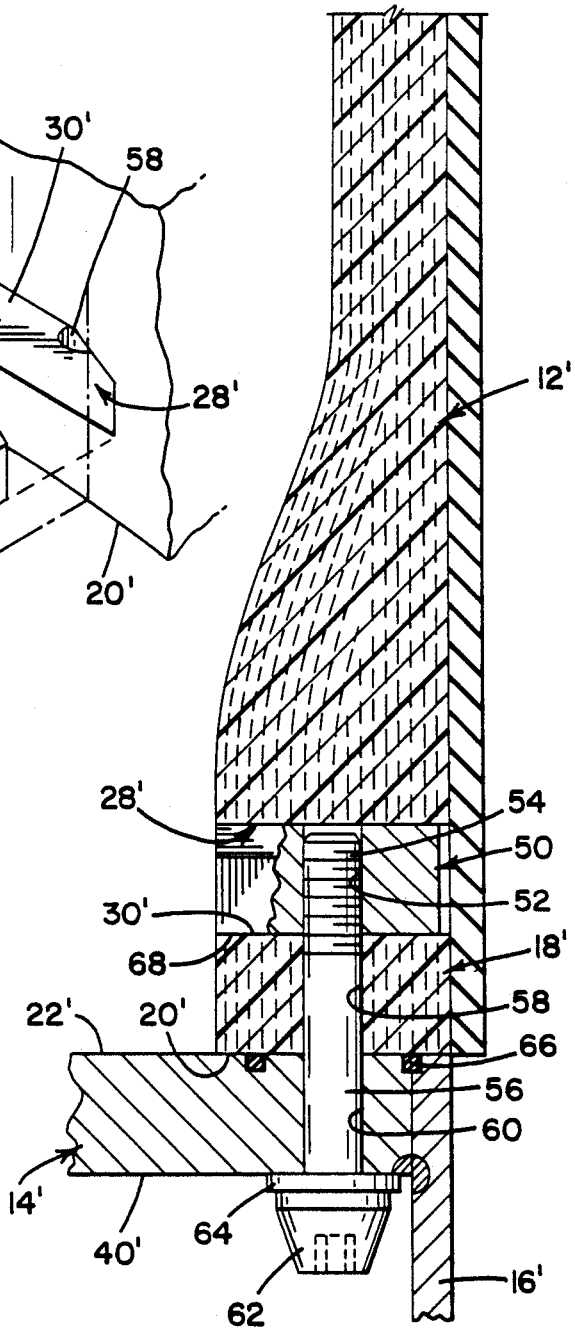

COMPOSITE STRUCTURE ATTACHMENT SYSTEM

FIELD OF THE INVENTION

This invention relates to apparatus for fastening a composite structure of laminated reinforced plastic such as a sonar dome to a supporting structure such as a bulkhead of a submarine where the forces on the connecting wall of the dome are multi-directional depending on the speed and attitude of the submarine.

BACKGROUND OF THE INVENTION

Heretofore composite structures of laminated reinforced plastic have been attached to a surface of a supporting structure by forming a flange at the edge of the composite structure and clamping the flange to the supporting structure. Holes were drilled in the flange and supporting structure and bolts inserted in the holes for bolting the flange to the supporting structure. Where the walls of the composite structure must be substantially thick to provide the necessary strength, it has not been feasible to provide a flange at the edge of the composite structure. Also, where the walls of the composite structure are of a thickness where flanges can be formed at the edge, there may be problems with shear failure and delamination due to the concentration forces at the flanges.

SUMMARY OF THE INVENTION

The present invention provides a system in which the sonar dome of laminated reinforced plastic has a substantially thick edge portion which is not flanged. Circumferentially spaced slots are provided in the thick edge portion and have flat surfaces for engaging corresponding flat surfaces of load-bearing members. The load-bearing members may be connected to a supporting structure such as a bulkhead of a submarine by bolt shanks extending through the edge portion or alongside the edge portion for attachment to the bulkhead.

In accordance with one aspect of the invention there is provided a composite structure attachment assembly comprising in combination a composite structure of laminated reinforced plastic having overlapping layers of fabric plies embedded in a thermoplastic material forming a unitary body, an edge portion of the composite structure having an edge surface for abutting engagement with a surface of a second structure, a slot spaced from the edge surface and extending through at least some of the overlapping layers of fabric plies, the slot having a flat surface generally parallel with the edge surface of the composite structure, a load-bearing member positioned in the slot having a flat surface for engagement with the flat surface of the slot and connecting means between the load-bearing member and the second structure.

DESCRIPTION OF THE DRAWINGS

FIG. 1 is an elevation with parts broken away of a composite structure such as a sonar dome embodying the invention attached to a rigid structure such as a bulkhead of a submarine.

FIG. 2 is an enlarged sectional view taken along line 2—2 in FIG. 1 showing the position of the bolt shanks in the holes in the bulkhead for retaining the load-bearing members in the slots of the composite structure.

FIG. 3 is a further enlarged fragmentary sectional view of the portion circled in FIG. 2 with parts broken away showing a load-bearing member in a slot of the composite structure.

FIG. 4 is a further enlarged fragmentary sectional view taken along line 4—4 in FIG. 3 with parts being broken away.

FIG. 5 is a fragmentary sectional view taken along line 5—5 in FIG. 4.

FIG. 6 is a view like FIG. 4 of a modification of the invention in which the load-bearing member has a threaded hole for receiving a threaded end of the bolt shank extending through a hole in the bulkhead and a hole in the edge portion of the composite structure.

FIG. 7 is an exploded view in perspective of the load-bearing member, bolt, washer and slotted edge portion of the embodiment shown in FIG. 6.

BEST EMBODIMENT OF THE INVENTION

Referring to FIGS. 1 through 5, a composite structure attachment assembly 10 is shown in which a composite structure such as a sonar dome 12 having a generally hemispherical shape is mounted on a second structure such as a bulkhead 14 fastened to a hull 16 of a submarine. The dome 12 has an edge portion 18 which is circumferentially continuous and has an edge surface 20 for engagement with a bulkhead surface 22.

As shown in FIGS. 3 and 4, the sonar dome 12 has a composite structure made up of overlapping layers 24 of fabric plies having lightweight, high strength cords extending in directions in which maximum stresses are applied to the sonar dome. The cords may be of the class of materials including fiberglass, carbon or Kevlar (a trademark of DuPont). The layers 24 of fabric plies are embedded in a suitable thermoplastic material such as an epoxy. In the embodiment shown there are about 200 layers 24 of fabric plies in the edge portion 18.

The composite structure attachment assembly includes load-bearing members such as plates 26 positioned in slots 28 spaced from the edge surface 20 of the sonar dome 12 and extending through the overlapping layers 24 of fabric plies. The slots 28 may have flat surfaces 30 which are generally parallel to the edge surface 20 of the sonar dome 12. Each of the plates 26 has an exposed end 32 which is connected to a suitable connecting means such as a bolt shank 34 at an inner peripheral side 36 of the edge portion 18. Each bolt shank 34 is positioned along the inner peripheral side 36 of the edge portion 18 and extends through a hole 38 in the bulkhead 14 to an inside surface 40 of the bulkhead where a nut 42 may be threaded on a projecting end 44 of the bolt shank. A suitable seal such as an O-ring 46 may be mounted in a groove in the inside surface 40 of the bulkhead 14 to prevent leakage of water through the hole 38.

The flat surfaces 30 of the slots 28 are in engagement with flat surfaces 48 of the plates 26 providing the maximum bearing surface. A plurality of the slots 28 are positioned around the edge portion 18 of the dome 12 to distribute the load evenly. For each of the slots 28 there is a hole 38 in the bulkhead 14 for containing a bolt shank 34 at the inner peripheral side 36 of the edge portion 18. This not only positions the sonar dome 12 but also retains the plates 26 in the slots 28 preventing them from sliding out. During assembly the plates 26 are inserted in the slots 28 before the sonar dome 12 is mounted on the bulkhead 14. Then each bolt shank 34 is inserted in a matching hole 38 in the bulkhead 14.

The plates 26 have a cross-sectional shape generally the same as the cross-sectional shape of the slots 28 for a close fit of the plates in the slots. With this construction, the edge portion 18 of the sonar dome 12 may be substantially thick to provide the necessary strength and at the same time avoid problems with shear failure and delamination due to concentration of forces.

SECOND EMBODIMENT OF THE INVENTION

Referring to FIGS. 6 and 7, a second embodiment of the invention is shown in which the parts that are identical with the parts shown and described for the embodiment of FIGS. 1 through 5 are identified by the same numeral with the addition of a prime mark. In this embodiment, load-bearing members such as plates 50 having the same general cross-sectional shape as the cross-sectional shape of the slots 28' are positioned in the slots. Each of the plates 50 has a a threaded hole 52 for threaded engagement with a threaded end 54 of a bolt shank 56 extending through a hole 58 in the edge portion 18' of the sonar dome 12'. For each hole 58 in the edge portion 18' a matching hole 60 is provided in the bulkhead 14' and a bolt head 62 is provided at the opposite end of each bolt shank 56 from the threaded end 54 for bearing against the inside surface 40' of the bulkhead 14'. A washer 64 may be positioned between the bolt head and the inside surface 40' of the bulkhead 14'. Sealing means such as an O-ring 66 may be disposed in a groove in the bulkhead surface 22' surrounding each hole 60 for preventing water from entering the space within the bulkhead 14' and hull 16'.

With this construction the sonar dome 12' may be attached to the bulkhead 14' by placing the plates 50 in the slots 28' of the edge portion 18' with the threaded hole 52 of each of the plates in alignment with a matching hole 58 in the edge portion 18'. The dome 12' is than placed on the bulkhead 14' with each hole 58 in the edge portion 18' in alignment with each hole 60 in the bulkhead. A bolt shank 56 is inserted through the holes 60 and 58 and threaded in the hole 52 of each of the corresponding plates 50. Each bolt shank 56 is then rotated to a predetermined torque to evenly distribute the pressure around the periphery of the edge portion 18'. Each of the plates 50 has a flat surface 68 for engagement with one of the flat surfaces 30' of the slots 28'. Also the edge surface 20' of the sonar dome 12' engages the bulkhead surface 22'.

While two preferred embodiments of the invention have been shown and described in detail, it should be apparent that various other modifications thereto without departing from the scope of the claims that follow.

What is claimed is:

1. A composite structure attachment assembly comprising in combination a composite structure of laminated reinforced plastic having overlapping layers of fabric plies embedded in a thermoplastic material forming a unitary body, an edge portion of said composite structure having an edge surface for abutting engagement with a surface of a second structure, a slot spaced from said edge surface and extending through at least some of said overlapping layers of fabric plies, said slot having a flat surface generally parallel with said edge surface of said composite structure, a load-bearing member positioned in said slot having a flat surface for engagement with said flat surface of said slot and connecting means between said load-bearing member and said second structure.

2. The composite structure attachment assembly of claim 1 wherein said connecting means includes a shank of a bolt with one end attached to said load-bearing member.

3. The composite structure attachment assembly of claim 2 wherein said shank of said bolt is connected to an exposed end of said load-bearing member and said shank is positioned along one side of said composite structure.

4. The composite structure attachment assembly of claim 2 wherein said load-bearing member has a threaded hole, said shank of said bolt extends from said edge surface of said composite structure through a hole in said composite structure into threaded engagement with said threaded hole in said load-bearing member.

5. The composite structure attachment assembly of claim 3 wherein said edge portion of said composite structure is circumferentially continuous and said exposed end of said load-bearing member is located at an inner peripheral side of said edge portion whereby said shank is confined within said composite structure for retaining said load-bearing member in said slot.

6. The composite structure attachment assembly of claim 5 wherein a plurality of additional slots in said composite structure are spaced circumferentially around said inner peripheral side of said edge portion with additional load-bearing members in said additional slots and additional shanks of bolts are connected to the exposed ends of said additional load-bearing members and are positioned along the surface of said inner peripheral portion for extension through said second structure whereby said additional shanks and said first-mentioned shank fix the position of said composite structure on said second structure.

7. The composite structure attachment assembly of claim 1 wherein said load-bearing member has a cross-sectional shape generally the same as the cross-sectional shape of said slot for a close fit of said load-bearing member in said slot.

8. The composite structure attachment assembly of claim 1 wherein said thermoplastic material is an epoxy and said layers of fabric plies are of a fabric having lightweight, high strength cords extending in the directions in which the maximum stresses are applied.

9. The composite structure attachment assembly of claim 8 wherein said cords are of the class of materials including fiberglass, carbon or Kevlar.

10. The composite structure attachment assembly of claim 8 wherein there are about two hundred of said layers of fabric plies in said edge of said composite structure and said slot extends through all of said layers of fabric plies.

* * * * *